US005080289A

United States Patent [19]

Lunzer

[11] Patent Number: 5,080,289

[45] Date of Patent: Jan. 14, 1992

[54] SPRAYING VOLTAGE CONTROL WITH HALL EFFECT SWITCHES AND MAGNET

[75] Inventor: Lawrence J. Lunzer, St. Louis Park, Minn.

[73] Assignee: Graco Inc., Minneapolis, Minn.

[21] Appl. No.: 528,420

[22] Filed: May 25, 1990

[51] Int. Cl.[5] ..... B05B 5/025

[52] U.S. Cl. ..... 239/690; 239/690.1; 239/691; 239/707

[58] Field of Search ..... 239/690, 690.1, 691, 239/707; 338/32 R, 32 H; 361/227, 228

[56] References Cited

U.S. PATENT DOCUMENTS

| | | | |
|---|---|---|---|
| 3,610,528 | 10/1971 | Felici . | |
| 3,731,145 | 5/1973 | Senay . | |
| 4,073,002 | 2/1978 | Sickles et al. | 239/690.1 |
| 4,219,865 | 8/1980 | Malcolm | 361/228 |
| 4,219,986 | 8/1980 | Malcolm . | |
| 4,266,262 | 5/1981 | Haase, Jr. . | |
| 4,290,091 | 9/1981 | Malcolm . | |
| 4,377,838 | 3/1983 | Levey et al. . | |
| 4,491,276 | 1/1985 | Reeves . | |
| 4,674,003 | 6/1987 | Zylka . | |
| 4,745,520 | 5/1988 | Hughey . | |
| 4,875,008 | 10/1989 | Lorenzen | 338/32 R |
| 4,914,376 | 4/1990 | Meyer | 338/32 R |
| 4,934,603 | 6/1990 | Lasley | 239/707 |
| 4,934,607 | 6/1990 | Lasley | 239/691 |

*Primary Examiner*—Andres Kashnikow
*Assistant Examiner*—Lesley D. Morris
*Attorney, Agent, or Firm*—Paul L. Sjoquist

[57] ABSTRACT

An electrostatic spray gun is provided with a spraying voltage control. The contol is produced by Hall effect or magnetoresistive circuitry incorporated with the circuitry of the spray gun. A variably positionable magnet is provided so that the operator may selectively adjust the spraying voltage by positioning the magnet relative to the Hall effect circuitry.

10 Claims, 5 Drawing Sheets

SPRAYING VOLTAGE CONTROL WITH HALL EFFECT SWITCHES AND MAGNET

BACKGROUND OF THE INVENTION

This invention relates generally to electrostatic spray coating apparatus and, more particularly, to an applicator or spray gun for use in such apparatus for atomizing and charging the coating material and further wherein the voltage charging the coating material may be selectively varied by the operator.

As suggested by U.S. Pat. Nos. 3,610,528, 3,731,145, 4,219,865, 4,377,838 and 4,491,276 the advantages and benefits of using electrostatic spray coating have long been recognized. The noted prior art discloses an evolutionary process in applicator design extending from spray guns which relied upon external power sources to produce the charged atomized coating material to spray guns having self-contained systems for producing voltage for charging the coating material being dispensed by the gun. In particular, two U.S. Pat. Nos., 4,219,865 and 4,290,091 (to Malcolm; owned by the assignee of the present invention) disclose the type of spray gun which has an entirely self-contained electrical power supply for charging the dispensed coating material. This type of spray gun provides the advantage of not requiring connection to an external power supply, thereby eliminating the need for power cords extending from the gun to an external power supply which adds weight to and reduces the mobility of the gun.

Another improvement manifested in the prior art is disclosed in U.S. Pat. Nos. 4,266,262, 4,674,003 and 4,745,520. These patents are directed generally to the concept of controlling or sensing the current which is provided to charge the coating material. U.S. Pat. No. 4,745,520 provides for sensing the output current whereby the sensed current controls the supply of operating potential. Similarly, U.S. Pat. No. 4,266,262 provides for control by a sensing signal which is transmitted to a counter circuit controlling a switching circuit which connects only a portion of alternating current cycles to the input depending upon the magnitude of the sensed signal. U.S. Pat. No. 4,674,003 includes a microcomputer for identifying the current flowing between the charging electrode and the workpiece whereby the optimum spray effect or constant high voltage is maintained.

Despite the improvements and advantages offered by the above-noted patents and refinements in electrostatic spray coating technology, there are some problems which have remained unaddressed. Some of these problems are addressed in a copending application (U.S. Ser. No. 446,810 now abandoned) owned by the assignee of the present invention, entitled *Solvent Resistant Electrostatic Spray Gun.*

The present invention is directed to another one of the problems which has remained unsolved in the prior art. Specifically, different paints or coating materials may require different charging voltages so that an appropriate and optimal finish may be achieved. Also the distance between the spray gun and the workpiece may vary and the shape of the workpiece may vary. Therefore, it would be advantageous if the operator of the spray gun could vary, conveniently and rapidly, the spraying voltage without resorting to electromechanical switches or wire mechanical linkages on the body of the spray gun and without resorting to a remote adjustment location for adjusting the voltage being supplied to the gun, thereby adjusting the spraying voltage with which the coating material is being charged.

SUMMARY OF THE INVENTION

The spray applicator gun of the present invention is directed to and in large part solves the aforementioned problems. Specifically, a spray gun is provided which enables controlling the spray voltage through the use of a magnetoresistive device or Hall effect device included in the circuitry of the gun. The magnetoresistive or Hall effect device, which may take the form of an integrated circuit, is used to sense the presence of magnetic flux.

It is a particular advantage of the spray gun of the present invention that the operator rapidly and conveniently may vary the electrostatic no-load voltage to provide the optimum transfer of atomized coating material to a workpiece and to provide the best overall appearance or finish of a coated workpiece for various available coating materials.

It is an important object of the present invention to provide an electrostatic spray gun with a self-contained electrical power supply wherein the spray gun operator conveniently, safely and quickly may selectively vary the spraying voltage.

It is another object of the present invention to provide an electrostatic spray applicator wherein the spraying voltage may be varied by the operator without resorting to electromechanical switches or other mechanical wire linkages.

It is another object of the present invention to provide an electrostatic spray gun having the capacity for providing a variable spraying voltage while maintaining the solvent-resistant integrity of the spray gun and of the power cartridge contained therein.

Yet another object of the present invention is to provide an electrostatic spray gun wherein the spraying voltage may be selectively varied and wherein the gun is reasonably priced, cost effective and durable.

Yet another object of the present invention is to provide an electrostatic spray gun wherein the operator may operate the spraying voltage selector while continuing to safely and securely grip and hold the spray gun in operational spray position.

An important feature of the present invention is that the spraying voltage produced by the electrostatic spray gun conveniently may be selectively varied by an operator to any desired voltage within high and low adjustment range limits. The limits may be preset at the time of manufacture or may be set by an end user to conform with particular user requirements. Additionally, the spraying voltage adjustment capacity is provided by a minimum number of components and by using components which involve a minimum amount of mechanical movement, thereby maintaining the solvent and coating material resistance of the spray gun.

Further objects, features and advantages of the present invention will be understood with reference to the following specification, the appended drawings and claims.

DETAILED DESCRIPTION OF THE PRESENT INVENTION

Figure 1:
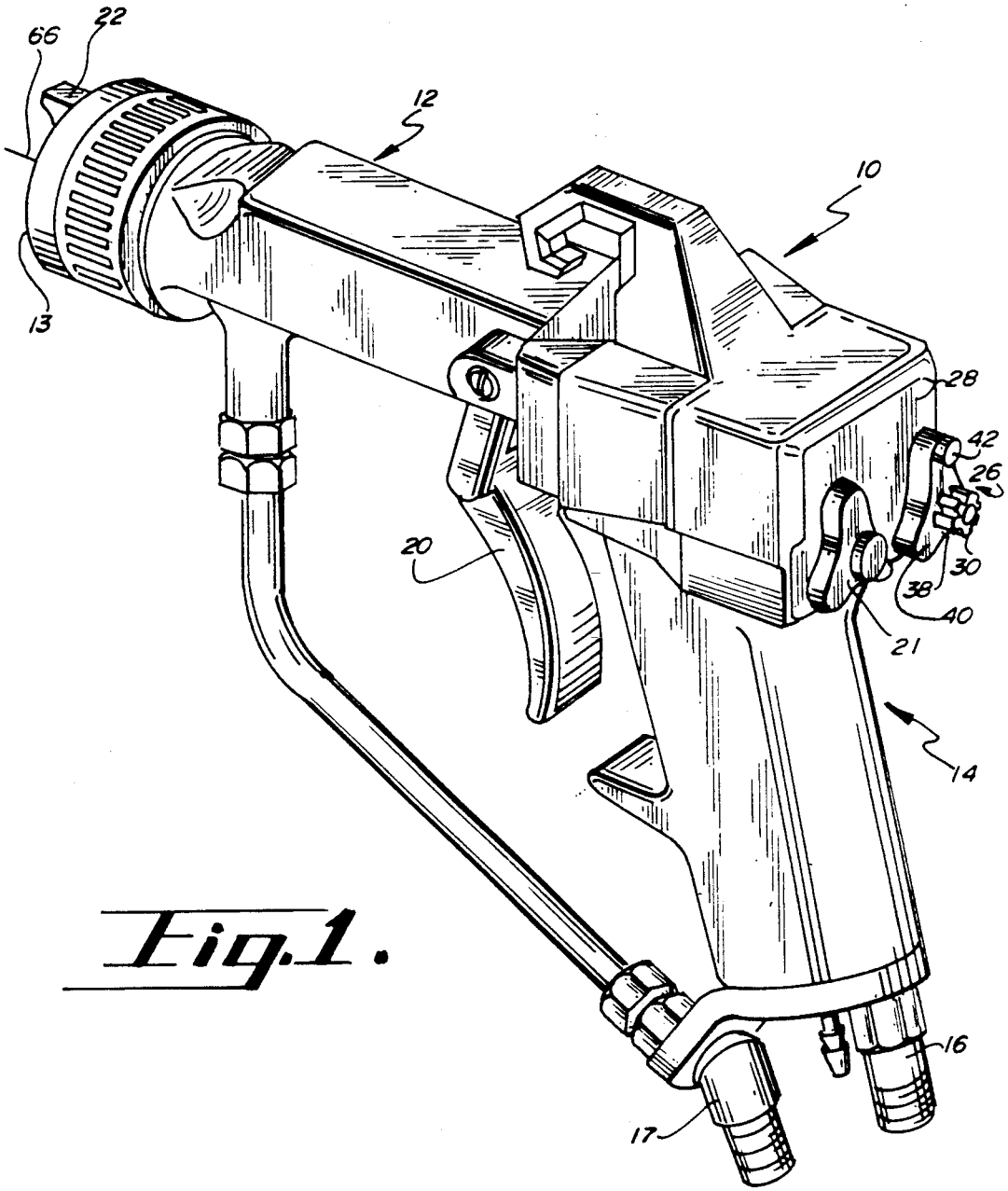
FIG. 1 is a perspective view of the spray applicator of the present invention.
Figure 2:
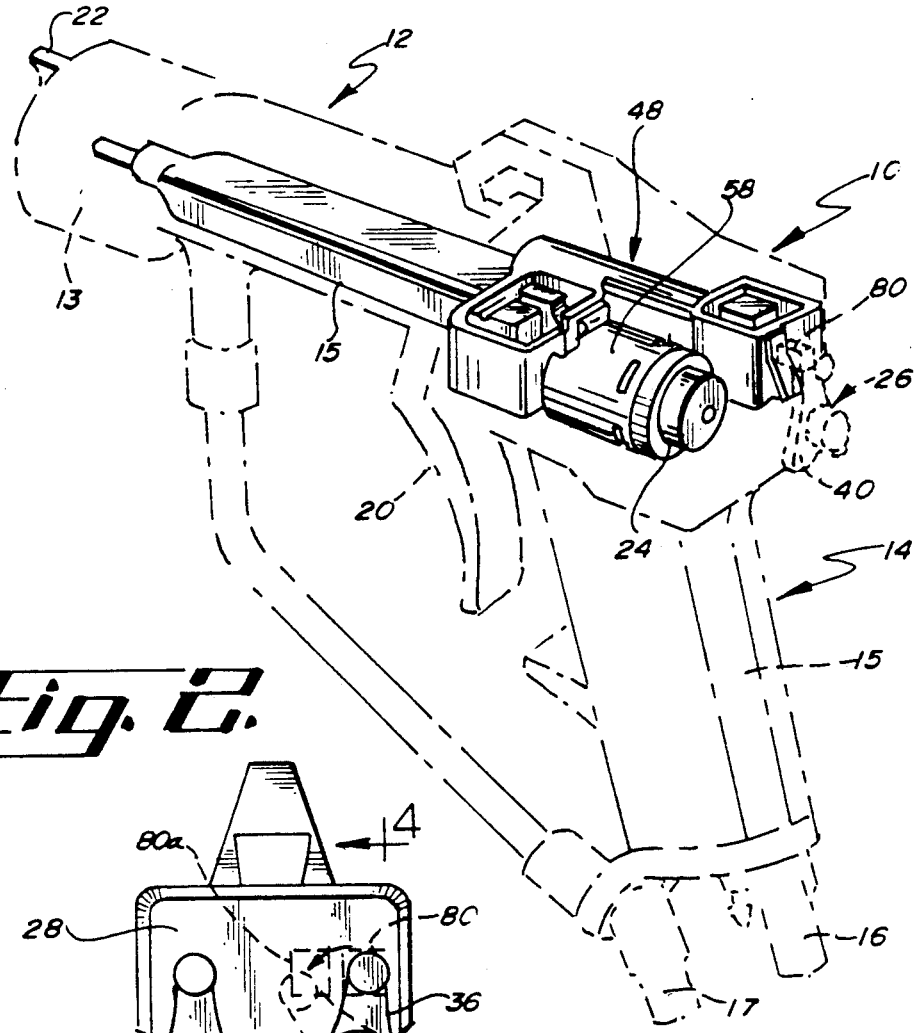
FIG. 2 is a perspective view showing the internal components of the spray gun of the present invention with the spray gun in phantom.

FIGS. 1 and 2 show that the gun 10 or applicator of the present invention has a barrel 12 and a handle 14. The barrel ends in a nozzle 13. The gun 10 is generally hollow, having chambers 15 in both the handle and the barrel for receiving electrical components and conduit. An air hose coupling 16 is provided on the handle 14 for connecting an air hose (not shown) thereto. A paint supply fitting 17 is also provided. A trigger control 20 operates an internal valve mechanism (not shown) for regulating the air flow therethrough. A switch 21 is provided for turning the charging voltage on or off by controlling air flow.

A plurality of generally tubular conduits extending through the gun body are not shown but are provided for directing air and coating material to the nozzle 13 where a spray cap assembly 22 is attached. Air is also supplied to an energy conversion turbine 58 for spinning the turbine 58 to produce alternating current for use as will be explained hereinbelow.

Figure 3:
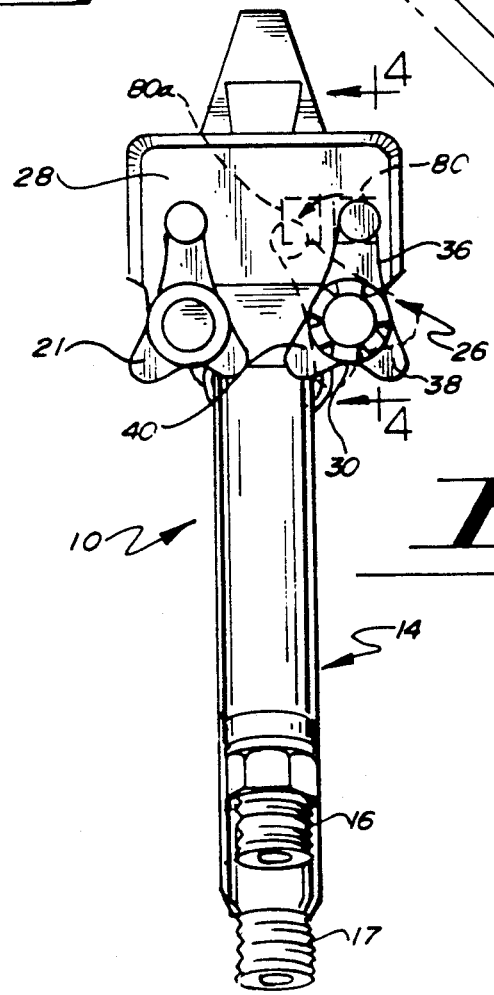
FIG. 3 is a rear elevation of the spray gun of the present invention.
Figure 4:
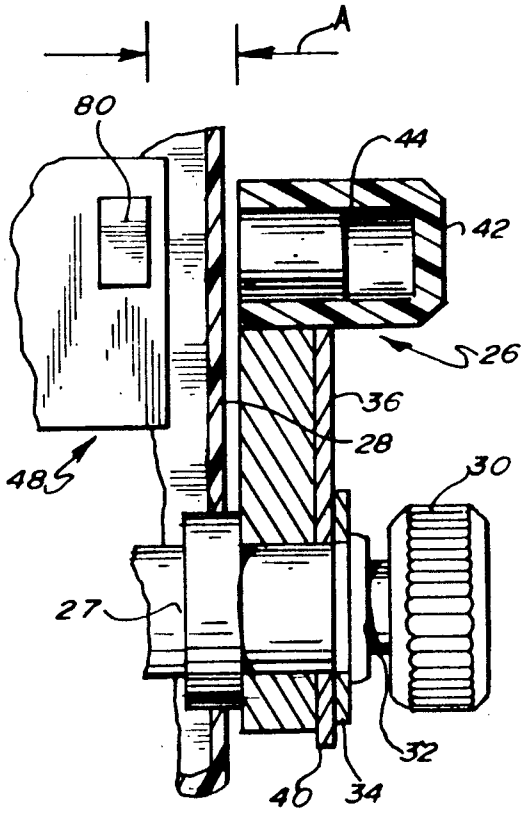
FIG. 4 is a partial section of the spray gun of the present invention taken along lines 4—4 in FIG. 3.

FIG. 3 shows a rear elevation of the gun 10 and, in particular, the flanged or lobed magnet arm 26 positioned over the gun rear faced plate 28. As shown in FIGS. 3 and 4, the lobed magnet arm 26 is attached on a stem 27 which is received in the gun 10 for rotary motion therein. A knurled knob 30 is provided on the exteriorly extending end 32 of the stem 27. The stem and knob are provided to control the flow of air to the nozzle 13 of the gun 10 and are pertinent to the present invention only in that they provide a convenient place for mounting the magnet arm 26.

Just inwardly of the knob 30 an E-ring 34 attaches the magnet arm 26 to the stem 27. The arm 26 has a magnet supporting flange 36 and a detent flange 38. A thumb lever 40 is also provided so that the operator may conveniently manipulate the magnet arm to selected positions. As shown in FIG. 4, a magnet receiving cup 42 attached near the end of the magnet arm 26 receives a magnet 44 which may be either threaded or press fit therein.

While a rotatable arm 26 is described for positioning the magnet 44 relative to the gun 10, it should be apparent that any suitable means for moving and positioning the magnet 44 relative to the gun 10 may be used. For example, a sliding switch mechanism (not shown) may be used and, as long as the magnet 44 may be moved to selected locations relative to the gun 10, any other equivalent structures will be within the scope of the present invention.

Figure 5:
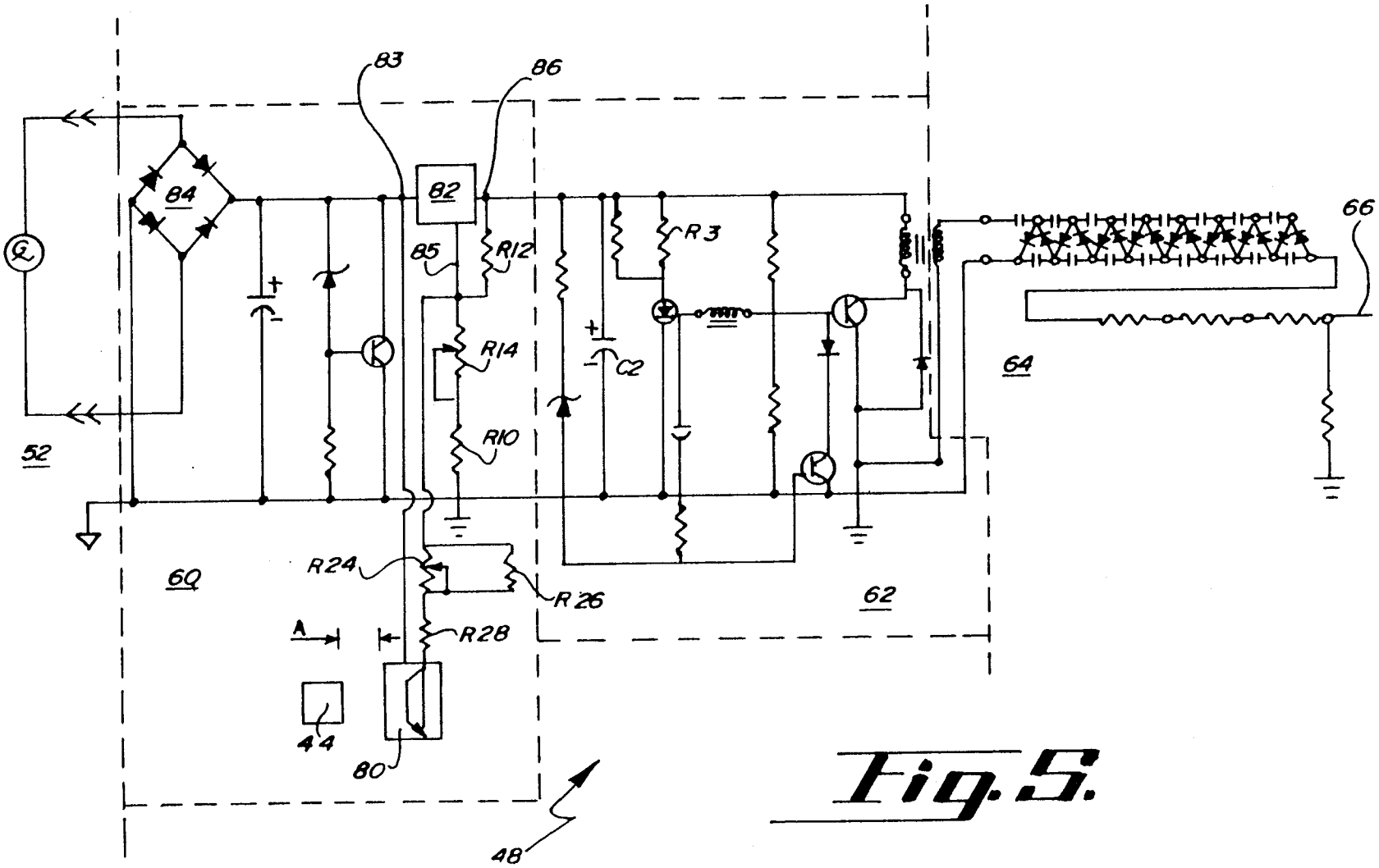
FIG. 5 is a schematic depicting the overall circuit of the spray gun on the present invention.

A self-contained electrical power supply 48 and its position in the spray gun 10 of the present invention are shown in FIG. 2. FIG. 5 shows specific electronic circuitry sections in components of the power supply 48. The power supply 48 is packaged into a cartridge made up of a kinetic energy conversion section 52, a rectifier and regulating section 60, an oscillator section 62 and a voltage transformer and multiplier section 64.

The energy conversion section 52 includes an air driven turbine 58 for producing an alternating current. The alternating current is converted to direct current in the rectifier and regulating section 60 where it produces a constant voltage at terminal 86. This constant voltage is connected to the oscillator section 62 which provides a substantially constant low alternating current voltage. The transformer and multiplier section 64 rectifies and increases this constant low alternating current voltage to the direct current spraying voltage required at electrode 66 for charging the atomized coating material leaving the gun nozzle 13. As shown in FIG. 5, the circuit components of the power supply 48, including the energy conversion section 52, the rectifier and regulating section 60, the oscillator section 62 and the transformer and multiplier section 64 generally are made up of conventional, commercially available circuit elements.

A linear regulator 82 is incorporated into the rectifier and regulating section 60. Input 83 delivers an unregulated direct voltage from the rectifier 84 to the regulator 82. A control input 85 is provided to selectively control the voltage from the regulator 82. Resistor R12 is provided to set up the bias for regulator 82 and resistors R10 and R14 are provided to set a "stop" for maximum no-load voltage for safety purposes. Together, the linear regulator 82, the resistors R10, R12, R14 and the control input 85 are a closed-loop control or regulation system for providing a substantially constant, selected and regulated voltage from the regulator 82 for delivery to the oscillator section 62 through output 86. One form of commercially available regulator which can perform the function of the linear regulator 82 is a type LT1085 manufactured by Linear Technology of California.

Figure 6:
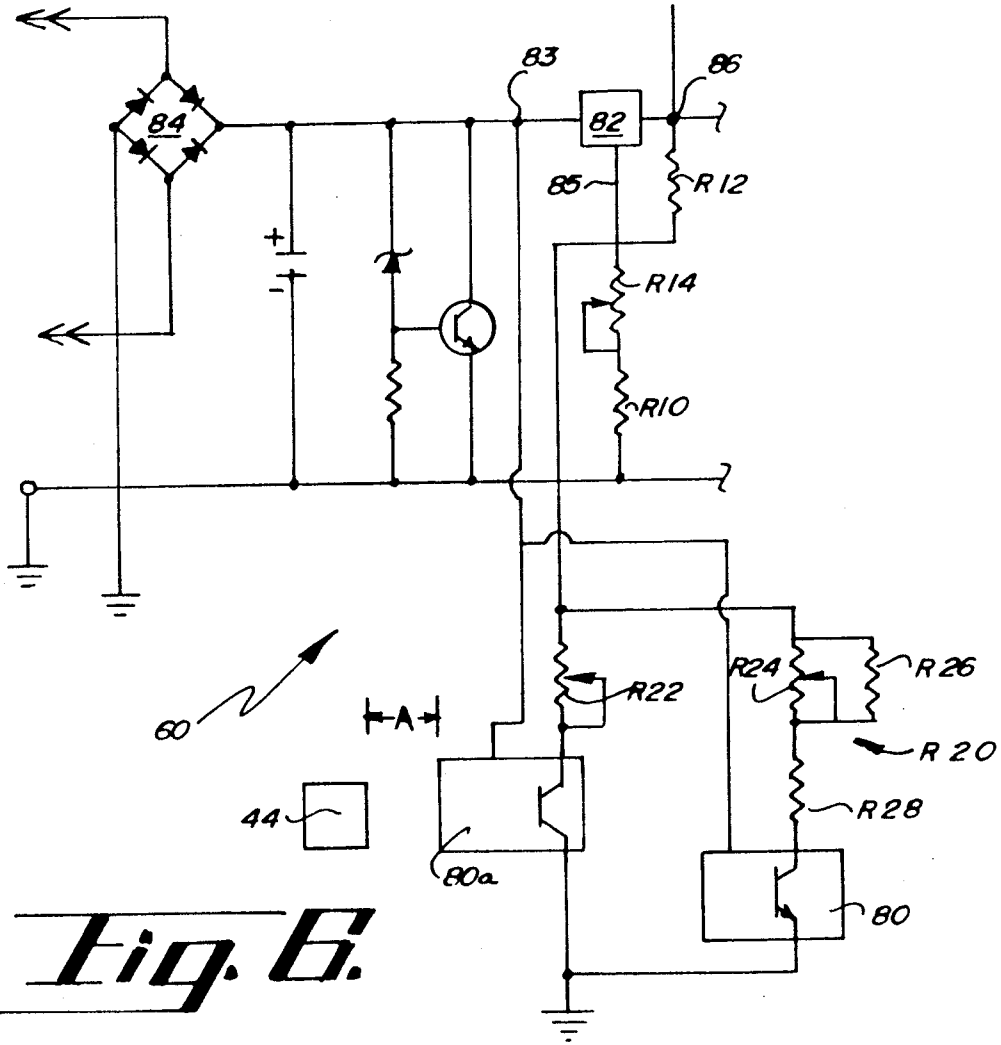
FIG. 6 is a partial schematic of a modified circuit for use in the present invention.

FIGS. 5 and 6 also show that the electrical circuitry at the power supply 48 includes a magnetoresistive device 80 in the rectifier and regulating sections 60. FIGS. 2–4 show where the device 80 may be located with respect to the gun 10 and to the power supply 48.

Specifically, a magnetoresistive switch or sensing device 80 is shown and it should be understood that any equivalent magnetoresistive device or magnetoresistive integrated circuit might be used. It should also be understood that the sensing device may be any Hall effect device or Hall effect integrated circuit. One type of magnetoresistive device which is suitable for this purpose is the SS series of position sensors manufactured by Honeywell of Minnesota.

The shown magnetoresistive device 80 is an integrated circuit that can sense the presence of a permanent magnet; for example, a magnet 44 attached near the gun 10 by the magnet arm 26 as shown in FIG. 4. Magnet 44 produces a flux density (measured in gauss) whereby, when brought into proximity or aligned with the magnetoresistive device, the magnetoresistive device changes it output from an off state to an on state. The sensing distance A (FIG. 5) between the magnetoresistive 80 and the magnet 44 may be related to the size and strength of the magnet 44 which may be selected as needs dictate.

All of the electrical components making up the power supply 48 generally are packed closely and may be suitably potted to form a solvent-resistent encapsulated power supply 48 which is received in the hollow body of the gun 10. The cartridge form of the power supply 48 makes the gun 10 field serviceable because one supply 48 may be interchanged easily with another. For ease of maintenance, it should be noted that the turbine 58 may be releasably and easily secured to the power supply 48 by a snap-ring 24 as shown in FIG. 2.

The normal or standard output voltage of the gun 10 is set by resistors R12, R14 and R10 and the linear regulator 82 (see FIG. 5). These components and this arrangement sets the highest voltage possible for power supply 48. The regulated voltage out may be set or determined by the resistor values chosen. The normal or standard output voltage of a gun 10 is customarily factory set. If and when a magnet 44 is moved by an operator into proximity or alignment with the magnetoresistive device 80, resistors R24, R26 and R28 are connected into the circuit, thereby changing the equivalent resistance to the linear regulator 82 and thus changing the output voltage.

In practice, for an 85 kV DC power supply 48, the variable resistor R24 shown in FIG. 5 can be factory set at a fixed value or it may be customer varied. By way of example, resistor R12 (value of 243 Ohms), resistor R14 (adjusted value of approximately 250 Ohms), resistor R10 (value of 2370 Ohms), resistor R26 (value of 243 Kilo Ohms), resistor R28 (value of 2.80 Kilo Ohms), set the highest spraying voltage when the magnetoresistive device 80 is turned on by placing magnet 44 near the magnetoresistive device 80 and the variable resistor R24 (value of zero Ohms to 50 Kilo Ohms) is adjusted to 50 Kilo Ohms. For an 85 kV spray gun this setting will provide an output voltage value of approximately 80 kV.

The minimum spraying voltage is set by the resistor R28, R12, R14 and R10 when the magnetoresistive device 80 is turned on and the 50 Kilo Ohm variable resistor R24 is adjusted to zero Ohms. In this adjustment, for an 85 kV gun, the output voltage typically will be 45 kV. If the magnet 44 is moved away from the magnetoresistive device 80 as shown in phantom in FIG. 3, the resistor R24 will be disconnected and the voltage will be the factory set voltage, 85 kV.

FIGS. 3 and 6 show that multiple magnetoresistive devices 80 and 80*a* may be incorporated into the circuitry of the power supply 48. The magnet 44 may be aligned with either of the two devices 80, 80*a* or not aligned with either of the devices 80, 80*a*; three different spraying voltages thus may be obtained. The two or more magnetoresistive devices 80, 80*a* approach could be used with an 85 kV power supply 48 with variable resistors or it may be customer varied. It should be understood that equivalent resistances R20 and R22 shown in FIG. 6 may be the same; that is, resistance R22 is comprised of the same resistance elements (R24, R26 and R28) as resistance R20.

In use, a paint supply and an air supply are connected to the paint supply fitting 17 and air hose fitting 16 respectively. As the trigger control 20 is operated, the released air serves to atomize the paint and drive turbine 58 to produce alternating current which is fed through the electrical circuitry of the power supply 48 to the transformer and multiplier section 64 and finally to the charging electrode 66, thereby charging the spray of atomized paint being discharged from the nozzle 13 of the gun 10.

By manipulating the magnet arm 26 between the positions shown in FIG. 3, the operator can change the magnetoresistive device 80 between an off state and an on state. By connecting a variable resistor R24 (FIG. 5) to the output of the magnetoresistive device 80, many selected different resistance loads can be switched on and off. This variable resistance will set the linear regulator 82 voltage level in the rectifier and regulating section 60 and in the oscillator section 62. This voltage level is directly and proportionally related to the spraying voltage produced by the transformer and multiplier section 64 at electrode 66.

Figure 7:
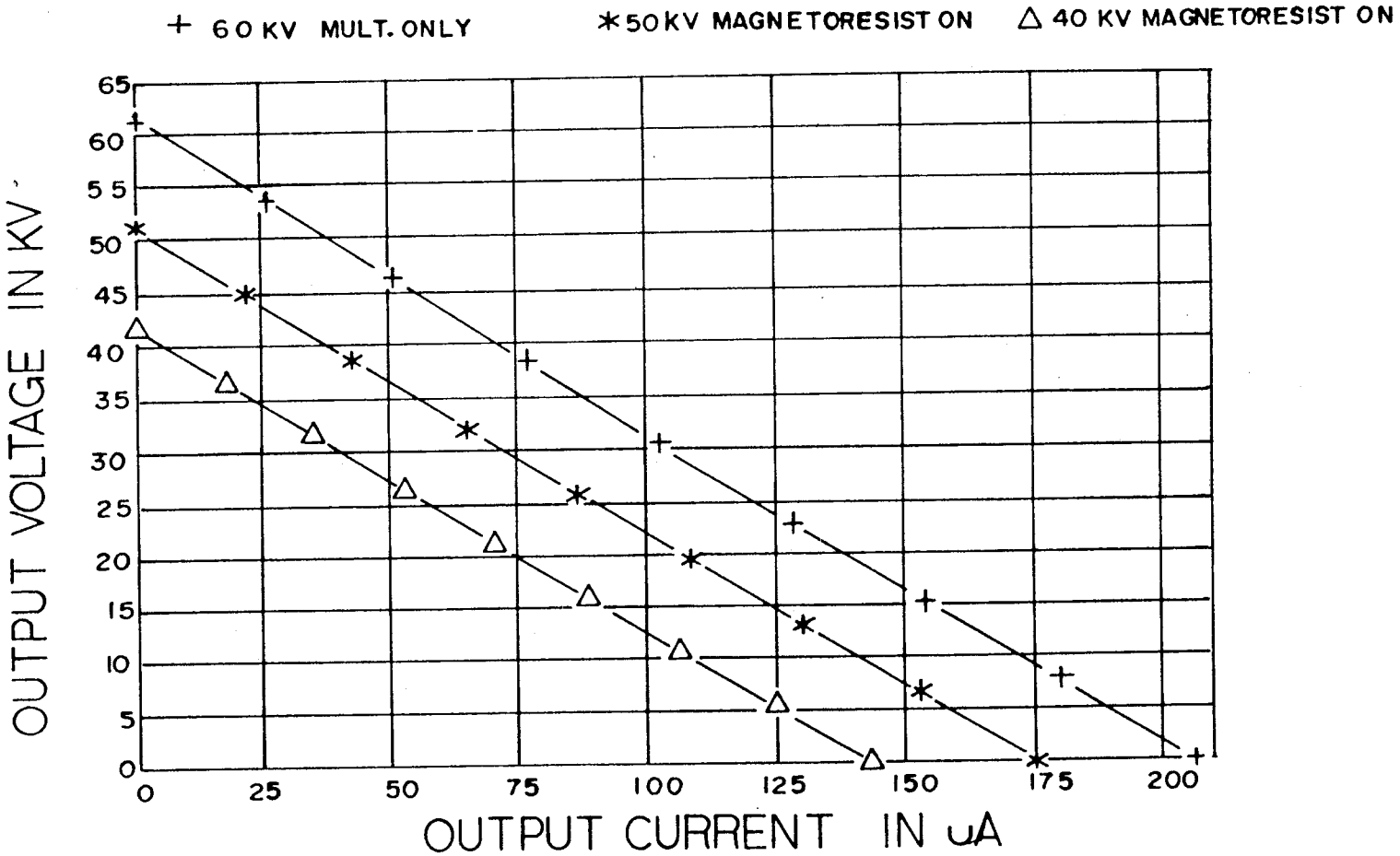
FIG. 7 graphically shows the relation of output voltage and output current when controlled according to the present invention.

The graph of FIG. 7 shows the relation of output voltage to output current for an 85 kV power supply 48. Three relations are shown; however, the circuitry can have as few as two (a no-load and another selected position) or as many as required positions for an operator to select from.

In addition to the depicted variations in circuitry (FIGS. 5–6) for the electrostatic gun 10 of the present invention, other changes within the scope of the present invention are possible. For example, the overall exterior configuration of the gun 10 may be different. The magnet 44 might be situated inside the gun 10. An additional mechanical activator, such as an air solenoid, might be provided to adapt the present invention for use with automatic spraying apparatus or to move or position the magnet 44 relative to the magnetoresistive device 80. The concept of varying input voltages prior to multiplying them to appropriate output voltages for electrostatically charging coating materials might be used with prior art technology such as that depicted in U.S. Pat. No. 3,731,145, generally known as low voltage cable electrostatic technology. Although specific magnitude charging voltages and circuitry are depicted and discussed, the circuitry described herein may be adapted to provide other charging voltages by changing the number of magnetoresistive devices or the number and value of circuit components.

The electrostatic spray applicator of the present invention described herein provides significant commercial advantages. Particularly, the spray gun allows the operator to conveniently and rapidly vary the no-load spraying voltage without varying the input voltage at a remote location. The spray gun of the present invention is solvent and paint resistant because there are no exposed electro-mechanical switches used to achieve the variation of the voltage and thus the gun is safe for use in hazardous environments. The spray gun of the present invention is durable and cost efficient since the power supplies are interchangeable. The gun may be used with magnets of various power and the gun may use only the barest number of additional components, that is, one equivalent resistance and a single Hall effect device per desired output voltage. Additionally, the present invention may be used with existing technology whether it be the type of self-contained electrostatic spray gun as described herein or the low voltage cable type gun.

The spray gun of the present invention may be embodied in other specific forms without departing from the spirit or essential attributes thereof and the embodiment described herein should be considered as illustrative, not restrictive. Reference should be made to the appended claims rather than foregoing description to indicate the scope of the invention.

What is claimed is:

1. An electrostatic spray applicator for coating work pieces with charged atomized material, said applicator comprising:

a) means for atomizing and emitting a spray of a coating materials;

b) electrode means for applying an electrical charge to the atomized coating material prior to its application to the workpiece;

c) an applicator contained power supply means for providing an operating voltage to said means for applying an electrical charge to the coating material, said power supply means including a turbine driven alternator for converting kinetic energy into voltage and multiplying means for raising the voltage to a high magnitude for charging the coating material; and d) said applicator having means for selectively varying the magnitude of the voltage produced for charging the coating material, comprising magnetoresistive circuitry incorporating a Hall effect device, and a magnet in selected and variable proximity to said magnetoresistive circuitry whereby the proximity of said magnet to the magnetoresistive circuitry determines the state of the circuitry.

2. The electrostatic spray applicator according to claim 1, wherein said magnetoresistive circuitry is incorporated with said power supply means.

3. The electrostatic spray applicator according to claim 1, wherein said magnet is movably attached to the applicator and may be moved to selected locations relative to the applicator and to the power supply means contained therein.

4. A charging voltage adjustment means for use in the electrostatic spray application of coating materials, wherein the coating material is electrically charged, said adjustment means being integrated with the applicator for applying the coating materials and comprising:

a) a magnetoresistive circuit comprising a Hall effect device; and b) a magnet in selected and variable proximity to said magnetoresistive circuit whereby the proximity of said magnet to said circuit determines the electrical state of said circuit.

5. An electrostatic spray gun for coating workpieces with coating material which has been atomized and charged by the gun, said gun comprising:

a) means for atomizing and emitting a spray of coating material;

b) means for applying an electrical charge to the atomized coating material;

c) circuit means for converting low voltage supplied at said gun into a high voltage for charging the coating materials; and d) means for selectively controlling the magnitude of said low voltage, comprising at least one magnetoresistive circuit incorporated with said means for applying an electrical charge to the atomized coating material, and at least one magnet in selected and variable proximity to said magnetoresistive circuit whereby the proximity of said magnet to the magnetoresistive circuit determines the electrical state of the circuit.

6. The electrostatic spray gun of claim 5, wherein said magnet is movably attached to the gun and may be moved to selected locations relative to the gun and to the means for supplying the electrical charge to the atomized coating materials.

7. A spray gun for connection to a remote source of coating material and air under pressure to atomize and spray the coating material, said gun further having a power supply means contained therein, said power supply means for electrically charging the coating material after it is atomized and comprising:

a) an energy conversion means including a rotatable turbine wherein the kinetic energy of the air moving through the gun under pressure is converted to alternating current;

b) a rectifying an regulating means connected to said energy conversion means wherein in said rectifying and regulating means the electrical current is converted to low voltage direct current;

c) an oscillator means section connected to said rectifying and regulating means, said oscillator means for amplifying and maintaining the current produced in the rectifying and regulating means;

d) a multiplier means connected to said oscillator means, said multiplier means for raising said low voltage direct current to a magnitude suitable for charging the coating material; and e) further wherein said rectifying and regulating means includes magnetoresistive circuitry comprising a Hall effect device integrated therewith.

8. The spray gun according to claim 7, wherein said gun has a magnet attached to the exterior thereof, said magnet being movably attached to the exterior of the gun in variable proximity to said magnetoresistive circuitry therein.

9. The charging voltage adjustment means according to claim 4, wherein said magnet is movably attached to the applicator and may be moved to selected locations relative to the applicator.

10. The charging voltage adjustment means according to claim 4, wherein said magnet is attached to an arm, said arm having a first end and distal end, said first end being pivotally secured to the applicator and said magnet being attached near said distal end, wherein the distal end and the magnet may be swung into selected positions relative to the applicator.

* * * * *